US005165478A

United States Patent [19]

Wilson

[11] Patent Number: 5,165,478

[45] Date of Patent: Nov. 24, 1992

[54] DOWNHOLE ACTIVATED PROCESS AND APPARATUS FOR PROVIDING CATHODIC PROTECTION FOR A PIPE IN A WELLBORE

[75] Inventor: Dennis R. Wilson, Ponca City, Okla.

[73] Assignee: Conoco Inc., Ponca City, Okla.

[21] Appl. No.: 761,196

[22] Filed: Sep. 16, 1991

[51] Int. Cl.[5] ..... E21B 41/02

[52] U.S. Cl. ..... 166/297; 166/241.1; 166/902

[58] Field of Search ..... 166/241.1, 242, 297, 166/902, 55, 244.1

[56] References Cited

U.S. PATENT DOCUMENTS

| | | | |
|---|---|---|---|
| 1,432,649 | 10/1922 | Wessels . | |
| 2,178,845 | 11/1939 | Baker . | |
| 2,654,435 | 10/1953 | Oliver . | |
| 2,743,781 | 5/1956 | Lane . | |
| 2,855,049 | 10/1958 | Zandmer . | |
| 2,874,783 | 2/1959 | Haines . | |
| 2,913,051 | 11/1959 | Lister . | |
| 3,120,268 | 2/1964 | Caldwell . | |
| 3,131,769 | 5/1964 | De Rochemont . | |
| 3,358,770 | 12/1967 | Zandmer . | |
| 3,448,805 | 6/1969 | Brown . | |
| 3,603,391 | 9/1971 | Yann . | |
| 4,157,732 | 6/1979 | Fonner . | |
| 4,286,662 | 9/1981 | Page, Jr. . | |
| 4,498,543 | 2/1985 | Pye et al. . | |
| 4,794,990 | 1/1989 | Riggs | 166/902 |
| 4,928,760 | 5/1990 | Freitas | 166/902 X |

*Primary Examiner*—William P. Neuder
*Attorney, Agent, or Firm*—John E. Holder

[57] ABSTRACT

This invention relates to a downhole activated device for providing cathodic protection for pipes in a wellbore for the production of hydrocarbons. The downhole activated devices are carried within either the pipe casing or the collars or both and remain generally within the maximum outward profile of the pipe string so as not to interfere with the movement and placement of the pipe string in the wellbore. The pipe string may be rotated, reciprocated and circulated which enhances the ability of the installer to place the pipe string in a deviated or long reach wellbore. Once the pipe string is in place, the devices may be deployed by one of several methods such that pistons mounted in openings in the peripheral wall of the pipe string move outwardly to contact the wall of the wellbore. Such contact with the walls of the wellbore insures that the sacrificial material in the pistons will corrode in preference to the remainder of the pipe.

19 Claims, 13 Drawing Sheets

DOWNHOLE ACTIVATED PROCESS AND APPARATUS FOR PROVIDING CATHODIC PROTECTION FOR A PIPE IN A WELLBORE

FIELD OF THE INVENTION

This invention relates to establishing wells for the production of hydrocarbons and more particularly to casing such wells for the production of hydrocarbons.

BACKGROUND OF THE INVENTION

In the process of establishing an oil or gas well, the well is typically provided with an arrangement for selectively excluding fluid communication with certain zones in the formation to avoid communication with undesirable fluids. A typical method of controlling the zones with which the well is in fluid communication is by running well casing down into the well and then sealing the annulus between the exterior of the casing and the walls of the wellbore with cement. Thereafter, the well casing and cement may be perforated at preselected locations by a perforating gun or the like to establish fluid communication with product bearing zones in the formation. The cement also prevents the fluids in adjacent zones which are otherwise sealed from the zone of interest by a fault or other geological condition from bypassing the geological seal by moving along the wellbore or well casing. However, the casing is typically subject to corrosion by contact with particular fluids in the wellbore or other material in the borehole.

It is conventional to provide corrosion protection for the casing in the wellbore by connecting the pipe to a metal plate selected for its electrochemical properties that cause the metal plate to corrode in preference to the casing. For example, magnesium is typical metal for cathodic protection of other metals such as steel. Typically, such protection is provided at the surface after the casing has been installed into the wellbore. However, the processes of corrosion and the establishment of cathodic protection for the pipe is not entirely satisfactory. There is a delay between the installation of the metal plate cathodic protection and the time it takes to protect the full casing. Thus, there is an initial period after the installation of the casing and before the cathodic protection is fully effective where portions of the casing will be subject to corrosion. If the casing were to be corroded through at any point it may compromise the seal between the casing and the formation.

Accordingly, it is an object of the present invention to provide a method and apparatus for protecting the pipe from corrosion which overcomes or avoids the above noted limitations and disadvantages of the prior art.

It is a further object of the present invention to provide a method and apparatus for protecting a pipe in a wellbore from corrosion from the time it is installed into the wellbore until supplemental corrosion protection may be provided.

SUMMARY OF THE INVENTION

The above and other objects and advantages of the present invention have been achieved in the embodiments illustrated herein by the provision of an apparatus comprising a piston for being mounted in an opening in the peripheral wall of the pipe and for extending generally radially outwardly from the pipe to contact the wall of the wellbore. The piston includes cathodic protection material. A deploying device deploys the piston from a retracted position which is generally within the maximum exterior profile of the pipe to an extended position wherein the piston extends generally radially from the opening to contact the wall of the wellbore. A securing arrangement is provided for securing the piston in the extended position to hold the pipe away from the wall of

BRIEF DESCRIPTION OF THE DRAWINGS

Some of the objects and advantages of the invention have been stated and others will become apparent as the description proceeds when taken in conjunction with the accompanying drawings in which—

DETAILED DESCRIPTION OF THE PREFERRED EMBODIMENTS

Figure 1:
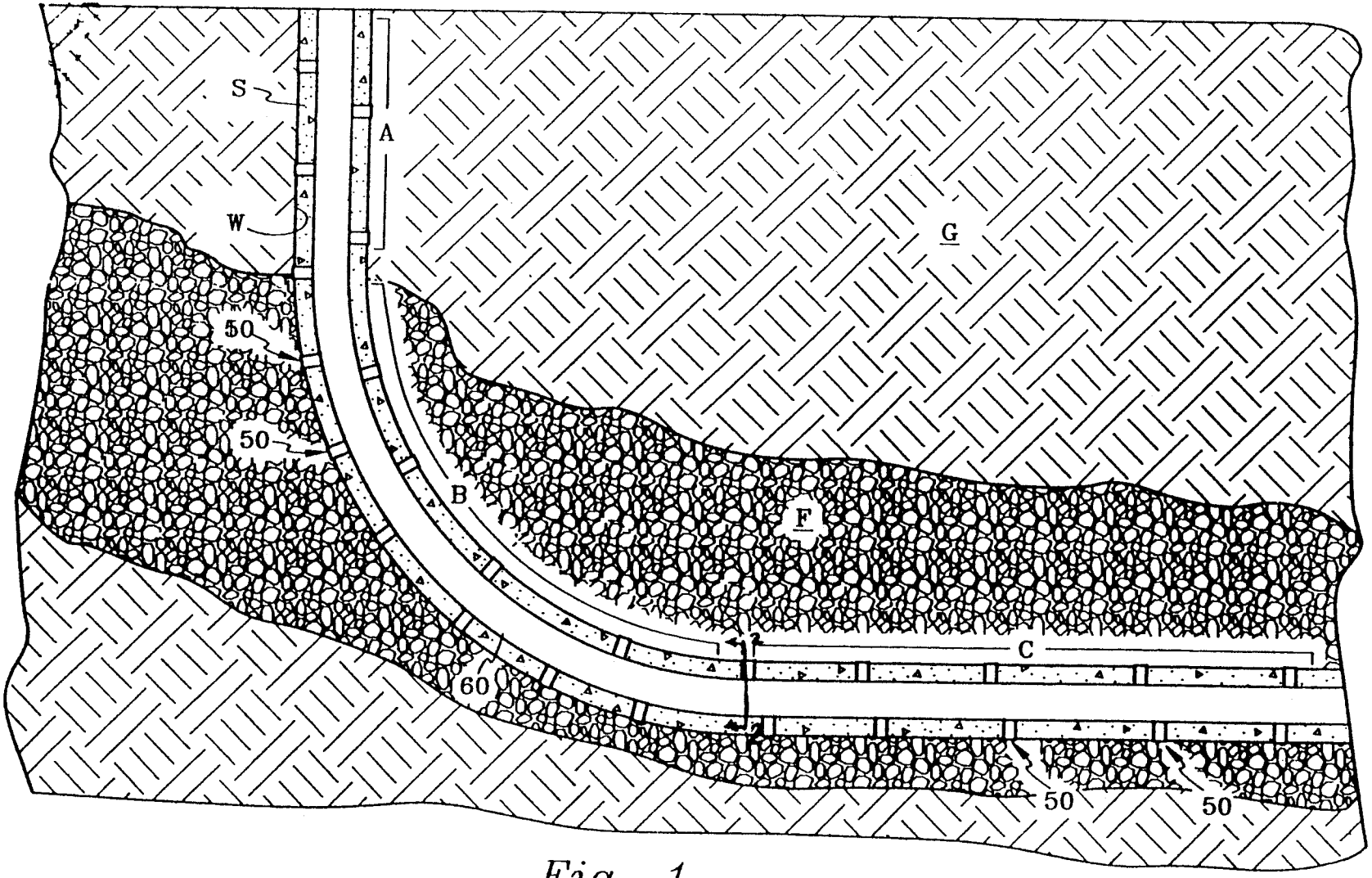
FIG. 1 is a cross sectional view of a wellbore in the ground with a casing string therein spaced from the walls of the wellbore by a plurality of downhole activated centralizers embodying the features of the present invention.

Referring more particularly to the drawings, FIG. 1 illustrates a wellbore W which has been drilled into the ground G. Such wells are often drilled for the exploration and production of hydrocarbons such as oil and gas. The illustrated wellbore W, in particular, includes a generally vertical section A, a radial section B leading to a horizontal section C. The wellbore W has penetrated several formations, one or more of which may be a hydrocarbon bearing zone. Moreover, the wellbore W was particularly drilled to have a horizontal section C which has a long span of contact with a particular zone of interest which may be a hydrocarbon bearing zone. With a long span of contact with a pay zone, it is likely that more of the hydrocarbon present will be produced. Unfortunately, there are adjacent zones which have fluids such as brine that may get into the production stream and have to be separated at additional cost. Accordingly, fluid communication with such zones is preferably avoided.

To avoid such communication with non-product bearing zones, wellbores are typically cased and cemented and thereafter perforated along the pay zones. However, in the highly deviated portions of a wellbore such as the radial section B and the horizontal section C of the illustrated wellbore W, the casing tends to lay against the walls of the wellbore preventing cement from encircling the casing and leaving a void for such wellbore fluids as brine to travel along the wellbore and enter the casing far from the formation in which it is produced. In the illustrated wellbore W, a casing string 60 has been run therein which is spaced from the walls of the wellbore W by a plurality of downhole activated centralizers, generally indicated by the number 50. The downhole activated centralizers 50 are retracted into the casing 60 while it is being run into the wellbore W. Once the casing 60 is suitably positioned in the wellbore W, the centralizers 50 are deployed to project outwardly from the casing as illustrated in FIG. 1. The centralizers 50 move the casing from the walls of the wellbore if the casing 60 is laying against the wall or if the casing is within a predetermined proximity to the wall of the wellbore W and thereby establish an annular free space around the casing 60. The centralizers 50 maintain the spacing between the casing 60 and the walls of the wellbore W while cement is injected into the annular free space to set the casing 60. Thereafter, the well may be managed like any other well.

Figure 3:
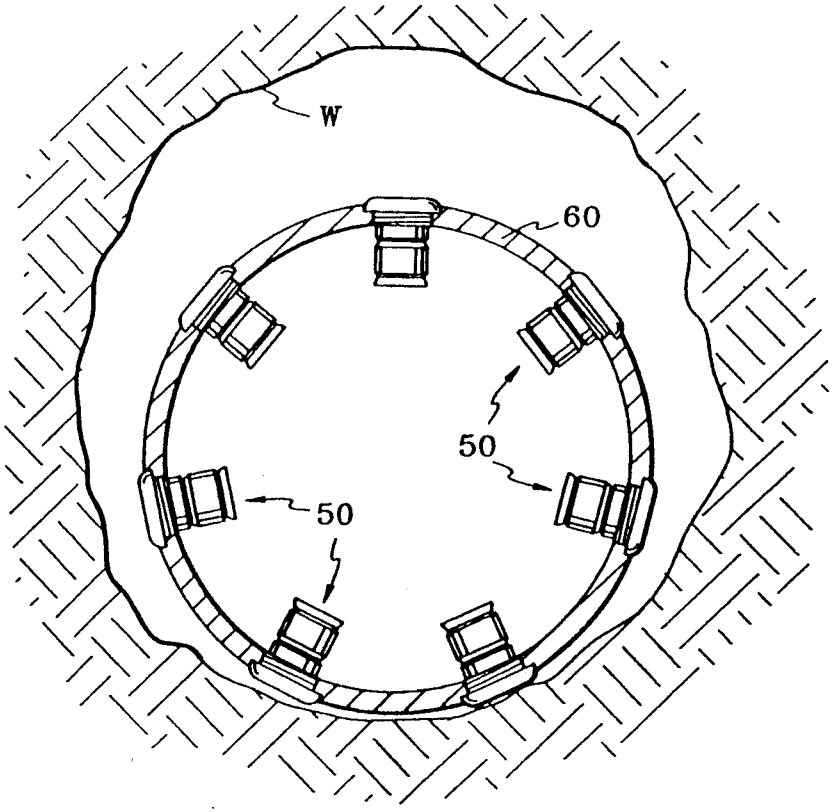
FIG. 3 is a cross sectional end view similar to FIG. 2 prior to the casing being centralized and with the downhole activated centralizers in the retracted position.
Figure 2:
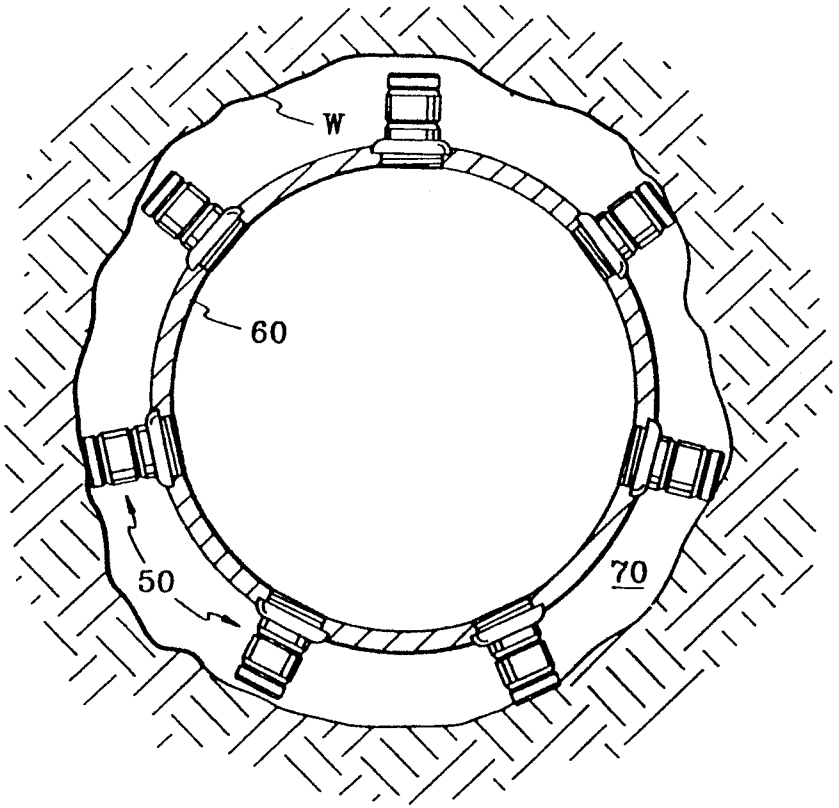
FIG. 2 is an enlarged cross sectional end view of the casing taken along Line 2—2 in FIG. 1.

The centralizers 50 are better illustrated in FIGS. 2 and 3 wherein they are arranged in the extended and retracted positions, respectively. Referring specifically to FIG. 2, seven centralizers 50 are illustrated for supporting the casing 60 away from the walls of the wellbore W although only four are actually contacting the walls of the wellbore W. It should be recognized and understood that the centralizers work in a cooperative effort to centralize the casing 60 in the wellbore W. The placement of the centralizers 50 in the casing 60 may be arranged in any of a great variety of arrangements. In particular, it is preferred that the centralizers 50 be arranged to project outwardly from all sides of the periphery of the casing 60 so that the casing 60 may be lifted away from the walls of the wellbore W no matter the rotational angle of the casing 60. It is also preferred that the centralizers 50 be regularly spaced along the casing 60 so that the entire length of the casing 60 is centralized. For example, in one preferred embodiment, the centralizers 50 are arranged in a spiral formation around the casing 60 such that each successive centralizer 50 along the spiral is offset at a 60° angle around the casing with respect to the adjacent centralizers 50 and displaced approximately six inches longitudinally from the adjacent centralizers 50. Therefore, there is a centralizer 50 arranged at the same angle every three feet along the casing 60. In a second preferred arrangement, the centralizers 50 are arranged in two parallel spirals such that each centralizer 50 has a centralizer positioned diametrically opposite thereto. In this arrangement, the centralizers 50 are arranged at 30° angles but have a twelve inch longitudinal spacing between successive centralizers 50 on each spiral. Thus, there is a centralizer arranged at the same angle every six feet. The 30° angular spacing of the centralizers should more than sufficiently cover the full periphery of the casing 60 and centralize the casing 60 regardless of its rotational angle. It should be understood that these are only two possible representative arrangements and that an infinite number of arrangements of the centralizers 50 may be devised. For example, it is conceivable that the centralizers 50 may be provided only in one radial orientation or within a predetermined radius of the casing which may extend for the entire length or for a longitudinal portion of the casing 60.

Focusing back on FIGS. 2 and 3, the seven illustrated centralizers 50 are mutually spaced around the casing 60 assuring that the orientation of the casing 60 in the wellbore W will not undermine the cumulative effect of the centralizers 50 to centralize the casing 60. As the casing 60 is centralized, an annular space 70 is created around the casing 60 within the wellbore W. The casing 60 is run into the wellbore W with the centralizers 50 retracted as illustrated in FIG. 3, which allows substantial clearance around the casing 60 and permits the casing 60 to follow the bends and turns of the wellbore W. Such bends and turns particularly arise in a highly deviated or horizontal well. With the centralizers 50 retracted, the casing 60 may be rotated and reciprocated to work it into a suitable position within the wellbore. Moreover, the slim dimension of the casing 60 with the centralizers 50 retracted may allow it to be run into wellbores that have a narrow dimension or that have narrow fittings or other restrictions leading into the well head.

In FIGS. 2 and 3 and in subsequent Figures as will be explained below, the centralizers 50 present small bulbous portions on the outside of the casing 60. It is preferable not to have any dimension projecting out from the casing to minimize drag and potential hangups while moving the string, however as will be discussed below, the exterior dimension of the bulbous portions are needed for the operation of each centralizer 50. It should also be recognized that the bulbous portions are rounded to slide better along the walls of the wellbore W and that the casing string 60 will include collar sections that will extend out radially farther than the bulbous portions. The collar sections present the maximum outer profile of conventional casing strings. The outward projection of the retracted centralizers 50 being within the maximum outer profile of the casing string 60 is believed not to present a problem running the casing.

Figure 4:
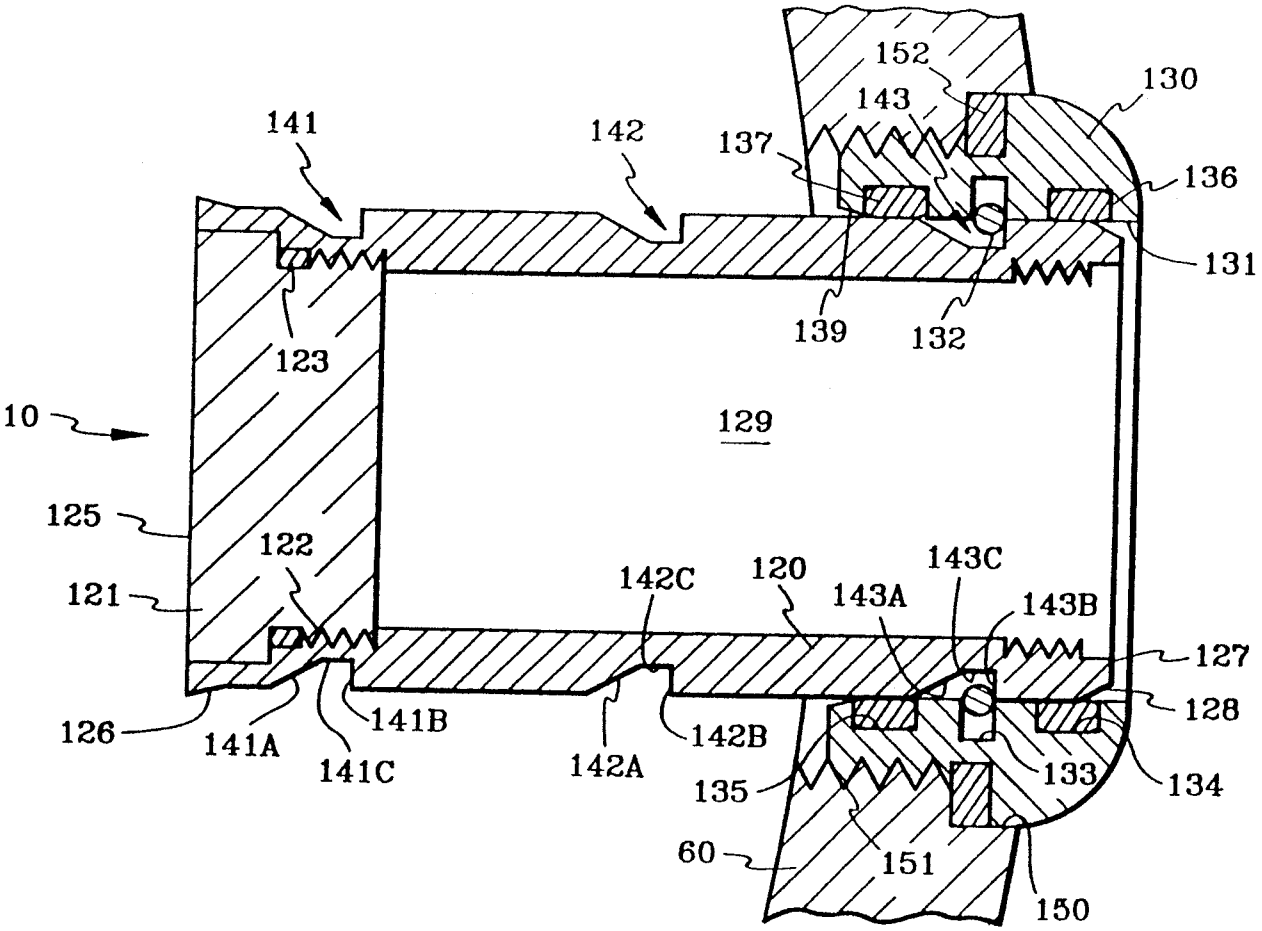
FIG. 4 is an enlarged fragmentary cross sectional view of a first embodiment of the downhole activated centralizer.

The centralizers 50 may take many forms and shapes as will be better understood after considering the various embodiments illustrated and described herein. The first embodiment of the centralizers 50 of the present invention is illustrated in FIG. 4 and comprises a piston 120 and a button 130 mounted in an opening 150 in the casing 60. The piston 120 is a generally cylindrical hollow tube having an internal passageway 129 therein. The button 130 is a slightly larger and shorter tubular element having a hole 131 therein for receiving the piston 120. The button is secured in the opening 150 by screw threads 151 such that it does not extend into the interior of the casing 60 but has a bulbous portion extending outwardly of the casing 60. An o-ring 152 provides a pressure tight seal between the button 130 and the casing 60.

The piston 120 is arranged for axial movement through the button 130 from a retracted position, in which it is illustrated, to an extended position, such as shown in FIG. 2 and FIGS. 5-7. The piston 120 and the button 130 are mounted in the casing 60 so that their axes are collinear and directed outwardly, preferably radially outwardly, with respect to the axis of the casing 60.

The piston 120 includes a plug 121 secured in the passageway 129 by screw threads 122. In the first embodiment, the plug 121 does not fill the entire passageway 129, but is rather approximately the thickness of the casing 60. An o-ring 123 provides a pressure tight seal between the piston 120 and the plug 121. The piston 120 further includes an inner end 125 and a distal end 127. At the inner end 125, the outer peripheral edge 126 is tapered outwardly, forming the broadest portion of the piston 120. At the distal end 127, the outer peripheral edge 128 is chamfered or tapered inwardly to ease the installation of the piston 120 into the button 130 as will be discussed below.

The piston 120 is mounted in a central hole 131 in the button 130 which is preferably coaxial to the opening 150 in the casing 60 and held in place by a snap ring 132. The snap ring 132 is located in a snap ring groove 133 milled in the interior wall of the button 130.

The piston 120 includes three radial piston grooves 141, 142, and 143 milled into the exterior thereof. The first of the three piston grooves is the radial securing groove 141 and is positioned adjacent the inner end 125 to be engaged by the snap ring 132 when the piston 120 is fully extended. The second of the three piston grooves is the central radial groove 142 and is centrally positioned along the exterior of the piston 120 to be engaged by the snap ring 132 when the piston 120 is partially deployed. The last of the three grooves is the radial retaining groove 143 positioned adjacent the distal end 127 to be engaged by the snap ring 132 when the piston 120 is in the retracted position. As the piston 120 is illustrated in FIG. 4 in the retracted position, the snap ring 132 is engaged in the radial securing groove 143.

The snap ring 132 is made of a strong resilient material to set into the snap ring groove 133 so that its inner periphery extends into the central hole 131 and more particularly into each of the radial grooves 141, 142 and 143. The snap ring 132 is resilient as noted above so that it can be deflected deep into the snap ring groove 133 to slide along the exterior of the piston 120 and allow the piston 120 to move from the retracted position to the extended position. The snap ring 132 must also be strong to prevent the piston 120 from moving unless a sufficient activation force is imposed on the piston 120 to deflect the snap ring 132 out of one of the radial grooves 141, 142, and 143 and deep into the snap ring groove 133.

The radial piston grooves 141, 142, and 143 have a shape that in conjunction with the snap ring 132 allows the piston 120 to move in one direction but not the other. In the direction in which the snap ring 132 allows movement, the snap ring 132 requires an activation or deploying force of a certain magnitude before it will permit the piston 120 to move. The magnitude of the activation or deploying force depends on the spring constant of the snap ring 132, the relevant frictional forces between the snap ring 132 and the piston 120, the shape of the piston groove, and other factors.

In particular, the piston grooves 141, 142 and 143 each have a sloped or tapered edge 141A, 142A, and 143A toward the inner end 125 of the piston 120. The sloped or tapered edge tends to push the snap ring 132 into the snap ring groove 133 when the piston 120 is moved outwardly from the casing 60. The piston grooves 141, 142, and 143 have an opposite edge 141B, 142B, and 143B which is square to the exterior of the piston 120 and will catch on the inner portion of the snap ring 132. Accordingly, the snap ring 132 will not permit the piston 120 to move inwardly into the casing 60 once it has engaged one of the piston grooves 141, 142, and 143. The piston grooves 141, 142, and 143 have a base or bottom 141C, 142C, and 143C which is recessed inwardly from the exterior of the piston 120 to allow the piston grooves 141, 142, and 143 to fully receive the snap ring 132 therein. The tapered peripheral edge 128 at the distal end 127 of the piston 120 also pushes the snap ring 132 into the snap ring groove 133 when the piston 120 is installed into the central hole 131 in the button 130.

The button 130 further includes a sealing arrangement to provide a pressure tight seal between the piston 120 and the button 130. In particular, the button 130 includes two o-rings 136 and 137 which are positioned on either side of the snap ring 132 in o-ring grooves 134 and 135, respectively. The o-rings 136 and 137 seal against the exterior of the piston 120 to prevent fluids from passing through the central hole 131 in the button 130. The o-rings 136 and 137 must slide along the exterior of the piston 120 passing the piston grooves 141, 142, and 143 while maintaining the pressure tight seal. Accordingly, it is a feature of the preferred embodiment that the spacing of the o-rings 136 and 137 is wider than each of the piston grooves 141, 142, and 143 and spaced apart at a different spacing compared to the spacing of the piston grooves. Therefore, as the piston 120 moves through the central hole 131 from the retracted position to the extended position, one of the o-rings 136 and 137 is in sealing contact with the smooth exterior of the piston 120 while the other may be opposed to one of the piston grooves 141, 142, and 143. Both o-rings 136 and 137 are never juxtaposed to the piston grooves 141, 142, and 143 simultaneously but rather at least one o-ring is in sealing contact with the exterior of the piston 120 at all times.

The piston 120, as noted above, further includes an outwardly tapered peripheral edge 126 at the inner end 125 which serves as a stop against the button 130 to limit the outward movement of the piston 120. The button 130 includes a chamfered edge 139 for engaging the outwardly tapered peripheral edge 126 wherein the inner end is approximately flush with the inner end of the button 130. Therefore, the piston 120 is fully recessed into the button 130 and clear of the interior of the casing 60.

As noted above, the centralizers 50 are initially provided in the retracted position so that the casing 60 can be run into the well W without the drag and interference of the centralizers 50 extending outwardly. The snap ring 131 is engaged with the retaining groove 143 to hold the piston in the retracted position until the piston is moved outwardly. As should be noted from the shape of the retaining groove 143, the square shoulder edge 143B will not slide past the snap ring 132 and thus the piston is prevented from being moved inwardly into the casing 60 from the retracted position.

Once the casing 60 is positioned in the wellbore W for permanent installation, the pistons 120 are deployed to the extended position. A deploying arrangement, as will be discussed below, provides a deploying force on the inner end 125 of each piston 120 to overcome the resistance of the snap ring 132 in retaining groove 143 and cause the sloped edge 143A of the retaining groove 143 to push the snap ring 132 into the snap ring groove 133. The deploying force further moves the piston 120 outwardly through the central hole 131 so that the snap ring 132 engages the central groove 141 and the securing groove 141 in succession.

The interaction between the snap ring 132 and the central groove 142 and the securing groove 141 is similar to the interaction between the snap ring 132 and the retaining groove 143 since the piston grooves 141, 142, and 143 are all of similar shape. During deployment, the snap ring 132 first engages the central groove 142. The snap ring 132 will have been pressed into the snap ring groove 133 by the tapered edge 143A and be sliding along the exterior of the piston 120 until it snaps over the square edge 142B into the central groove 142. If the distal end 127 of the piston 120 has contacted the wall of the wellbore W, the piston 120 would push the casing away from the wall of the wellbore W to centralize the casing 60. However, if the piston 120 meets with such resistance that it cannot fully extend to the extended position, the central groove 142 would maintain some clearance from the wall of the wellbore W.

As illustrated in FIGS. 2 and 3, the casing 60 and centralizers 50 are selected based on the size of the wellbore W so that the pistons 120 may fully extend to the extended position and contact the walls thereof around most of the casing 60. Accordingly, during deployment of the piston 120, the deploying force is expected to move the piston 120 to its fully extended position wherein the snap ring 132 will snap into the central groove 142 and then be pushed back into the snap ring groove 133 by the sloped edge 142A as the piston 120 moves to the fully extended position. The snap ring 132 will then snap into the securing groove 141 over the square edge 141B. The square edge 141B prevents the piston 120 from retracting back into the casing 60 as do the square edges 142B and 143B.

At about the same time that the snap ring 132 engages the securing groove 141, the outwardly tapered edge 126 at the inner end 125 of the piston 120 engages the chamfered edge 139 of the button 130 to stop the outward movement of the piston 120. Accordingly, once the snap ring 132 snaps into the securing groove 141, the piston 120 cannot extend outwardly farther and cannot be retracted. The securing groove 141 may have alternatively been provided with square edges at both sides rather than having a tapered edge 141A, but the tapered edge 141A helps ease the o-ring 137 across the radial groove 141 rather than catching and perhaps shearing the o-ring 137. The sloped edges 128, 143A, 142A, and 141A along the piston 120 all provide for smooth movement of the o-rings 136 and 137 into contact with the exterior of the piston 120.

Figure 5:
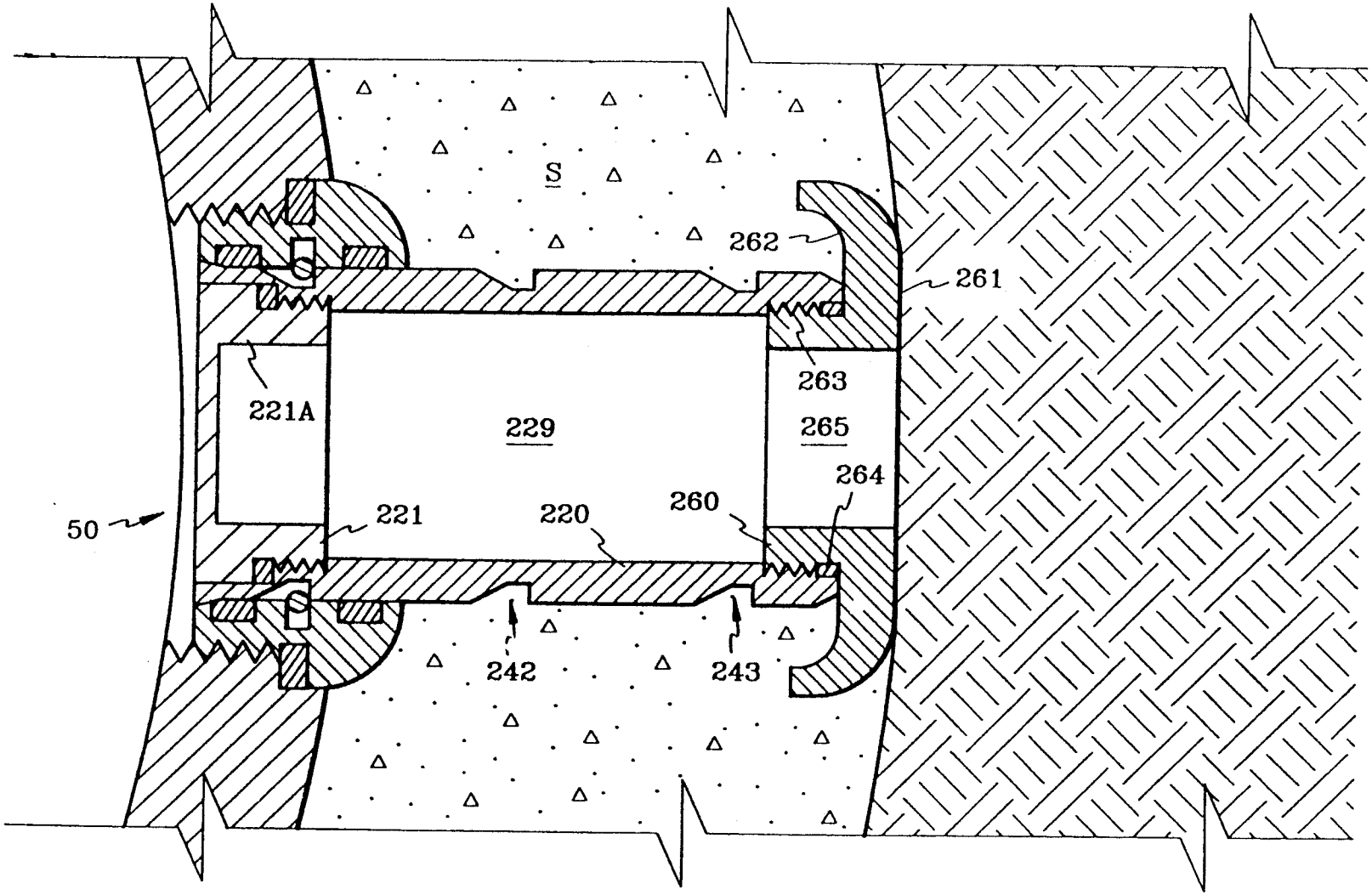
FIG. 5 is a fragmentary cross sectional view similar to FIG. 4 of a second embodiment of the downhole activated centralizer.

A second embodiment of the centralizer 50 is illustrated in FIG. 5 wherein components of the second embodiment which are similar to components in the first embodiment are indicated by the same numbers with the prefix "2". Therefore, in FIG. 5, the piston is indicated by the number 220 wherein the piston in the first embodiment is indicated by the number 120.

In the second embodiment, the centralizer 50 comprises a piston 220 which is virtually identical to the piston 120 in the first embodiment. The second embodiment further includes a shoe 261 connected at the distal end of the piston 220 by screw threads 263. The shoe 261 provides the centralizer 50 with a larger contact surface against the formation for use in the event the formation is soft and will let the piston push into the formation rather than pushing the casing away from the formation. An o-ring 264 is provided to seal between the shoe 261 and the piston 220. The shoe 261 further includes a curved back wall 262 to overlay the button and a curved outer face to provide a low drag contour similar to the bulbous shape of the button. Also, it should be noted for purposes of the following discussion that the shoe 261 includes an internal passageway 265 in communication with the passageway 229 of the piston 220.

The second embodiment of the centralizer 50 includes a plug 221 which is substantially different than the plug 121 in the first embodiment. In particular, the plug 221 is designed to be removed from the piston 220 once the casing 60 is fully installed in the wellbore W so that fluids such as oil or gas are able to pass from the formation into the casing 60. The plug 221 includes a thin wall 221A which is designed to have the strength to withstand the forces and pressures involved with running the casing 60 into the wellbore W and deploying the pistons 220. However, the thin wall 221A will later be destroyed by any of various methods to open the passageway 229 for the passage of fluids. For example, the material of the plug 221 may be particularly selected to be acid destructible so that the plug 221 may be destroyed by an acid treatment of the well through the casing 60. The casing 60 and the piston 220 are preferably made of steel and the plug 221 may be made of aluminum or magnesium or plastic or other suitable acid destructible material. While a thick walled plug would still be destroyed by the acid treatment, the thin wall 221A allows the plug to be destroyed in a short amount of time. A typical acid treatment would be hydrochloric acid.

Alternatively, the plug 220 may be destroyed by providing the casing 60 with substantial pressure to rupture the plug 221. If there is substantial pressure in the formation, the casing 60 may be provided with a vacuum the lower the pressure therein so that the formation pressure will rupture the plug 221. In the latter case, any debris from the plug 221 will not interfere with production of oil or gas from the formation. It should be recognized that there may be other methods of removing the plug 221 which a person having ordinary skill may utilize.

Figure 6:
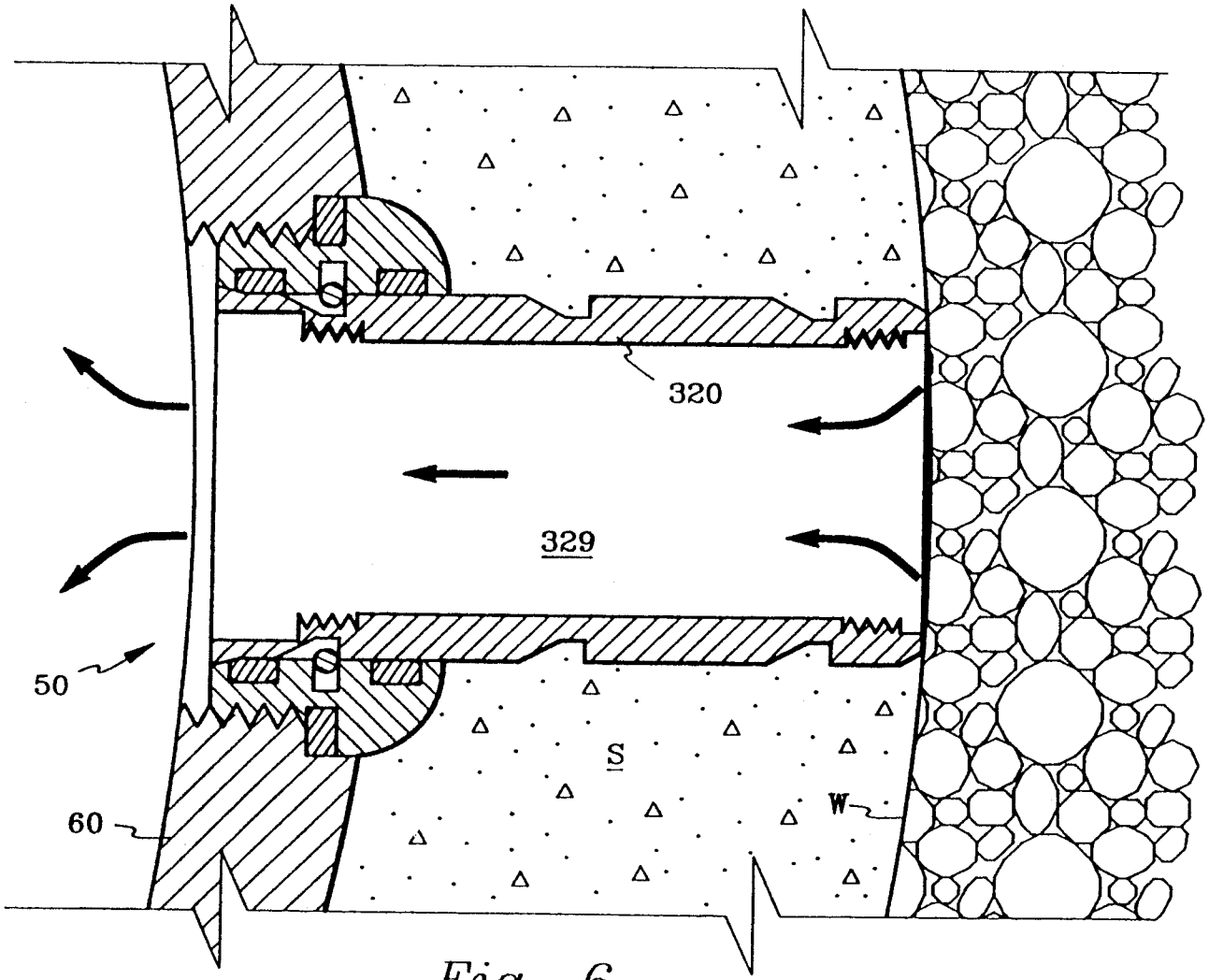
FIG. 6 is a fragmentary cross sectional view of a third embodiment of the downhole activated centralizer.

The third embodiment of the invention is illustrated in FIG. 6 with the plug removed and the passageway clear for fluid to move from the formation into the casing as indicated by the arrows. While the plug is illustrated as completely removed, it is recognized that perhaps there might be some remnant of the plug remaining around the periphery of the passageway 329. If the plug is made of material that is destroyed by acid or subject to corrosion, it is likely that by contact with downhole fluids, or by subsequent acid treatments, the remainder of the plug would eventually be removed from the piston 320. Once communication with the formation is established by removing the plug, the formation may then be developed as a conventional well such as by the aforementioned acid treatments or by fracturing the formation with substantial pressures to enhance communication or production from the formation.

Figure 7:
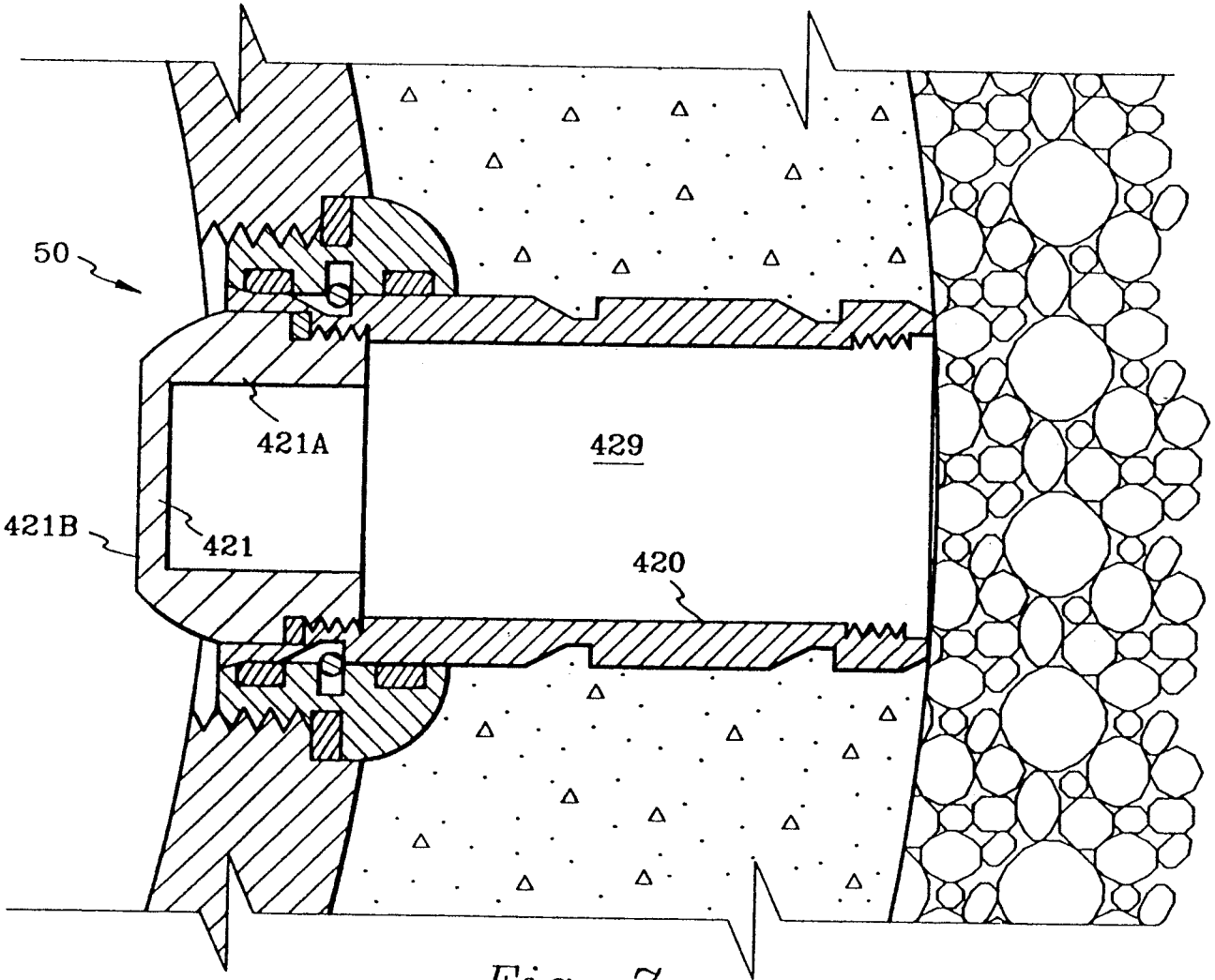
FIG. 7 is a fragmentary cross sectional view of a fourth embodiment of the downhole activated centralizer.

A fourth embodiment of the invention is illustrated in FIG. 7, which includes a fourth embodiment of the plug 421. The components of the fourth embodiment which are similar to components of a previous embodiment are similarly numbered with the prefix "4" so that the piston in FIG. 7 is indicated by the number 420. In particular, the fourth embodiment includes a plug 421 formed of a closed end tube having a tubular portion 421A and a closed end portion 421B. The plug 421 attaches to the piston 420 by screw threads as the previous two embodiments, but extends into the interior of the pipe casing 60 beyond the inner end of the piston 420. Actually the tubular portion 421A extends into the interior of the casing 60 and the closed end is entirely within the casing when the piston 420 is in the extended position. Thus, a severing device such as a drill bit or other equipment may sever the closed end portion 421B and open the passageway 429 for the passage of fluids from the formation into the casing 60. Therefore, fluid communication with the formation is accomplished by mechanical destruction of the plug 421. As with the previously discussed embodiment, once the plug 421 is destroyed, or in this case severed, the casing 60 is in fluid communication with the formation at the distal end of the piston 420.

Figure 8:
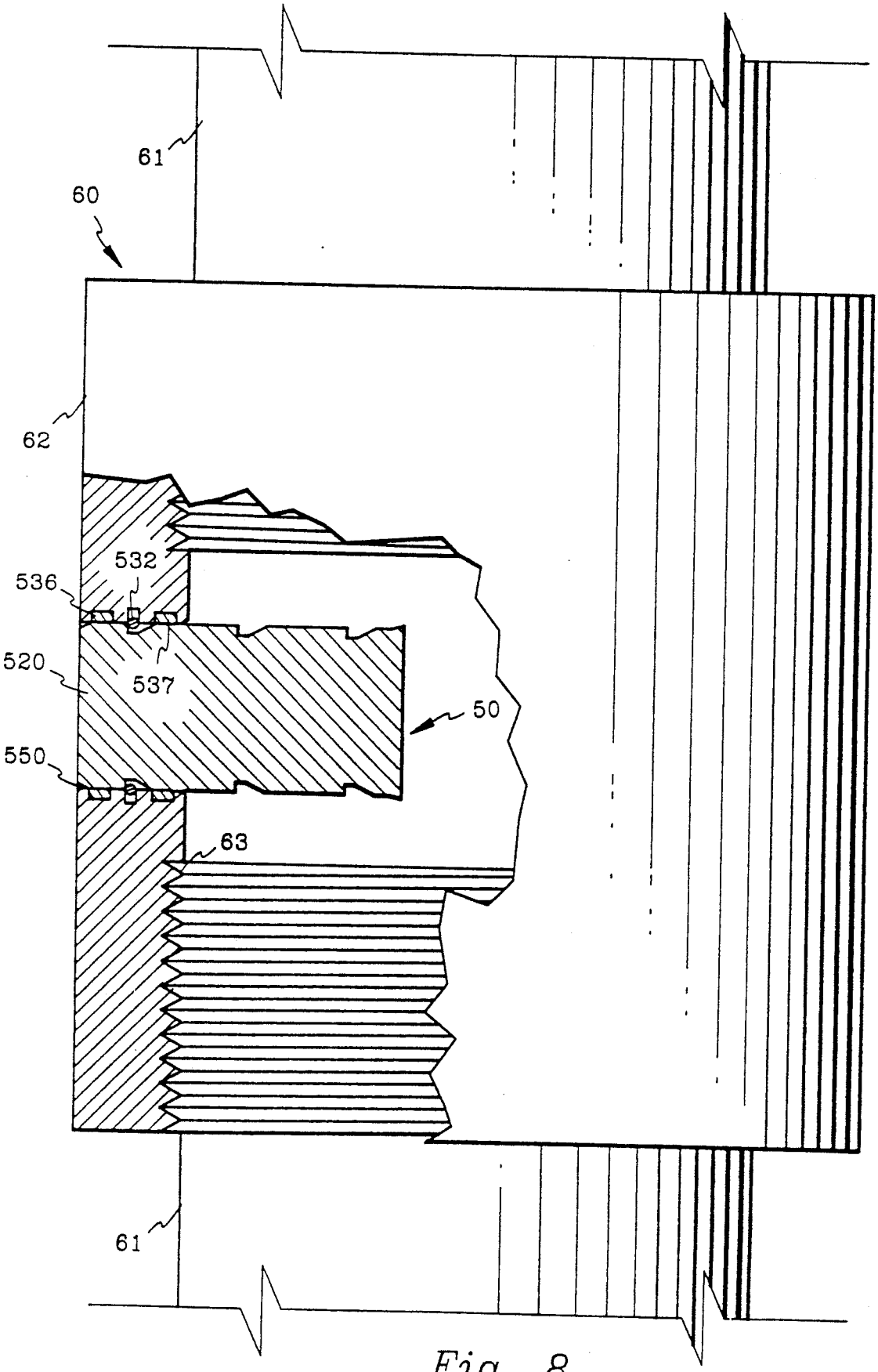
FIG. 8 is a fragmentary cross sectional view of a fifth embodiment of the downhole activated centralizer.

A fifth embodiment of the centralizer 50 is illustrated in FIG. 8, wherein as before, similar components are similarly numbered with the prefix "5". In the fifth embodiment, the piston 520 is solid having no internal passageway. Also, the fifth embodiment does not include a button. The fifth embodiment is directed to an application wherein the centralizers 50 are installed in the collars 62 rather than in the joints 61. The collars 62 connect the successive joints 61 together by screw threads 63 as would a conventional collar, but rather than allow the joints 61 to abut one another within the collar 62, the joints 61 are held spaced apart to allow for the pistons 520 to have room to extend into the interior of the casing 60. By this embodiment, conventional low cost casing joints without collars may be used without incurring the additional machining costs to provide centralizers therein; the centralizing function would be carried entirely at the collars 62.

The piston 520 retains the same exterior shape of the previous embodiments, but the snap ring 532 and the o-rings 536 and 537 have been mounted in the opening 550 in the collar 62. It should be noted that the distal end of the piston 520 is flush with the exterior of the collar 62 therefore being within the outer profile of the casing 60 while the casing 60 is being run in the wellbore W. The centralizer in this embodiment is intended to be the most simple and straight forward of the designs.

Figure 9:
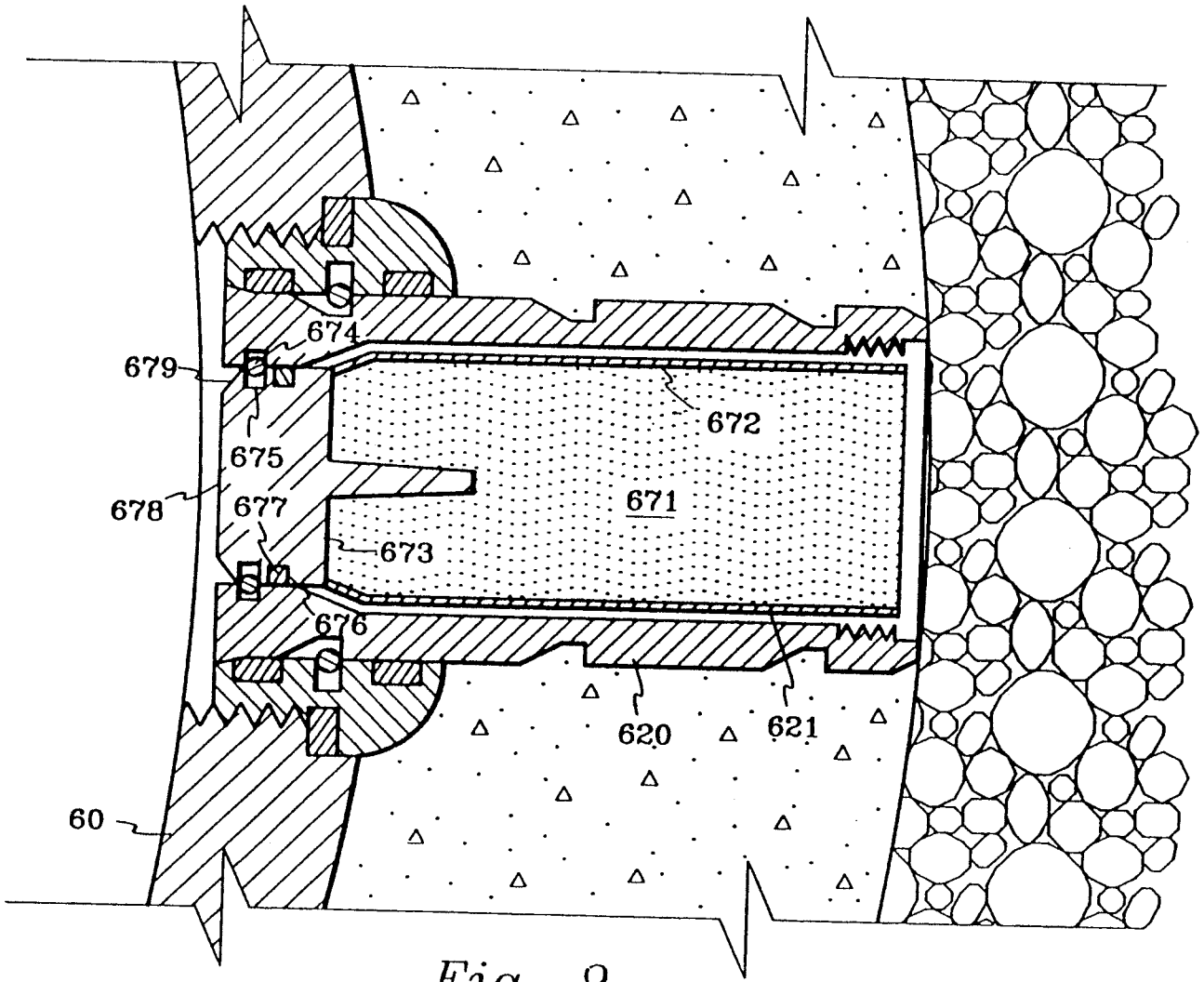
FIG. 9 is a fragmentary cross sectional view of a sixth embodiment of the downhole activated centralizer.

The sixth embodiment, illustrated in FIG. 9, provides several advantages over previous embodiments. In the sixth embodiment, the plug 621 is installed into the piston 620 from the distal end thereof rather than the inner end as in the previous embodiments. Secondly, the plug is secured into the passageway of the piston 620 by a snap ring 674 rather than being secured by screw threads. Thus, the button 630 and piston 620 may be installed into the casing 60 before the plug 621 is installed, and the plug 621 is simply inserted from outside of the piston 620 until the snap ring 674 snaps into place.

Figure 10:
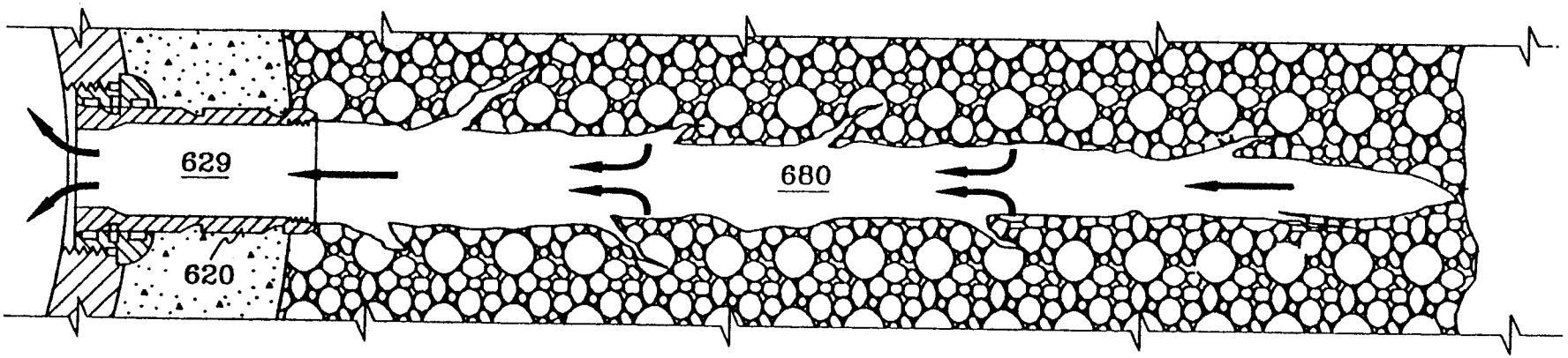
FIG. 10 is a fragmentary cross sectional view of the sixth embodiment of the downhole activated centralizer illustrating the perforation made into the formation.

In particular, the piston 620 includes a reduced diameter portion near the inner end thereof with a groove 675 milled therein. The plug 621 includes a snap ring 674 located in a snap ring groove 674A for engaging the groove 675 in the reduced diameter portion of the piston 620. The plug 621 is inserted into the distal end of the piston 620 and includes a base end 678 with a tapered portion 679 for guiding the plug 621 down the length of the passageway 629 (FIG. 10). The snap ring 674 is pushed into the snap ring groove 674A by the sloping surface inside the piston 620 leading to the reduced diameter portion until the snap ring 674 snaps into the groove 675. The plug 621 further includes an o-ring 677 installed in an o-ring groove 676 for providing a pressure tight seal between the piston 620 and the plug 621.

The plug 621 further differs from the previous plug embodiments in another substantial manner. The plug 621 includes an explosive charge to perforate the formation as well as remove itself from the piston 620 to open up the passageway 629 (FIG. 10). In particular, the plug 621 includes a charge of explosive material 671 within a sleeve 672. The base or inner end of the plug 621 comprises a detonator 673 to detonate the explosive material 671. The detonator 673 may operate by electrical or hydraulic means as is known in the detonator or explosives art, however, the explosive charge 671 is not intended to be detonated until the pistons 620 are deployed to the extended position and the casing 60 has been cemented in place.

Referring now to FIGS. 9 and 10, the explosive charge 671 is expected to create a large perforation 680 within the adjacent formation. Also, detonation of the charge 671 will destroy the plug 621 opening the passageway 629 of the piston 620. Thus, the passageway 629 will be clear for the formation to be in communication with the casing 60. This embodiment should be quite favorably compared with conventional perforating devices which must penetrate the casing and the annular layer of cement which absorb a large amount of the explosive energy. The present invention, on the other hand, concentrates all the explosive energy at the formation creating a large and extensive perforation 680. With a large perforation 680 in the formation, production of the hydrocarbons will enhanced or be more efficient.

One particular advantage of the sixth embodiment, is that the since the explosive charge 671 may be installed from the outside of the piston 620, the charge 671 need not be installed into the casing 60 until just before the casing 60 is run into the wellbore W. Accordingly, the charges 671 may be safeguarded away from most personnel so as to minimize their risk and exposure.

It should also be noted that while the sixth embodiment will accomplish the task of centralizing the casing as the previously discussed embodiments are, it is not necessary that this embodiment be used for centralizing. In other words, the casing 60 may be centralized by other means such as by conventional centralizers and the pistons 620 are then only used for perforating the formation.

Figure 11:
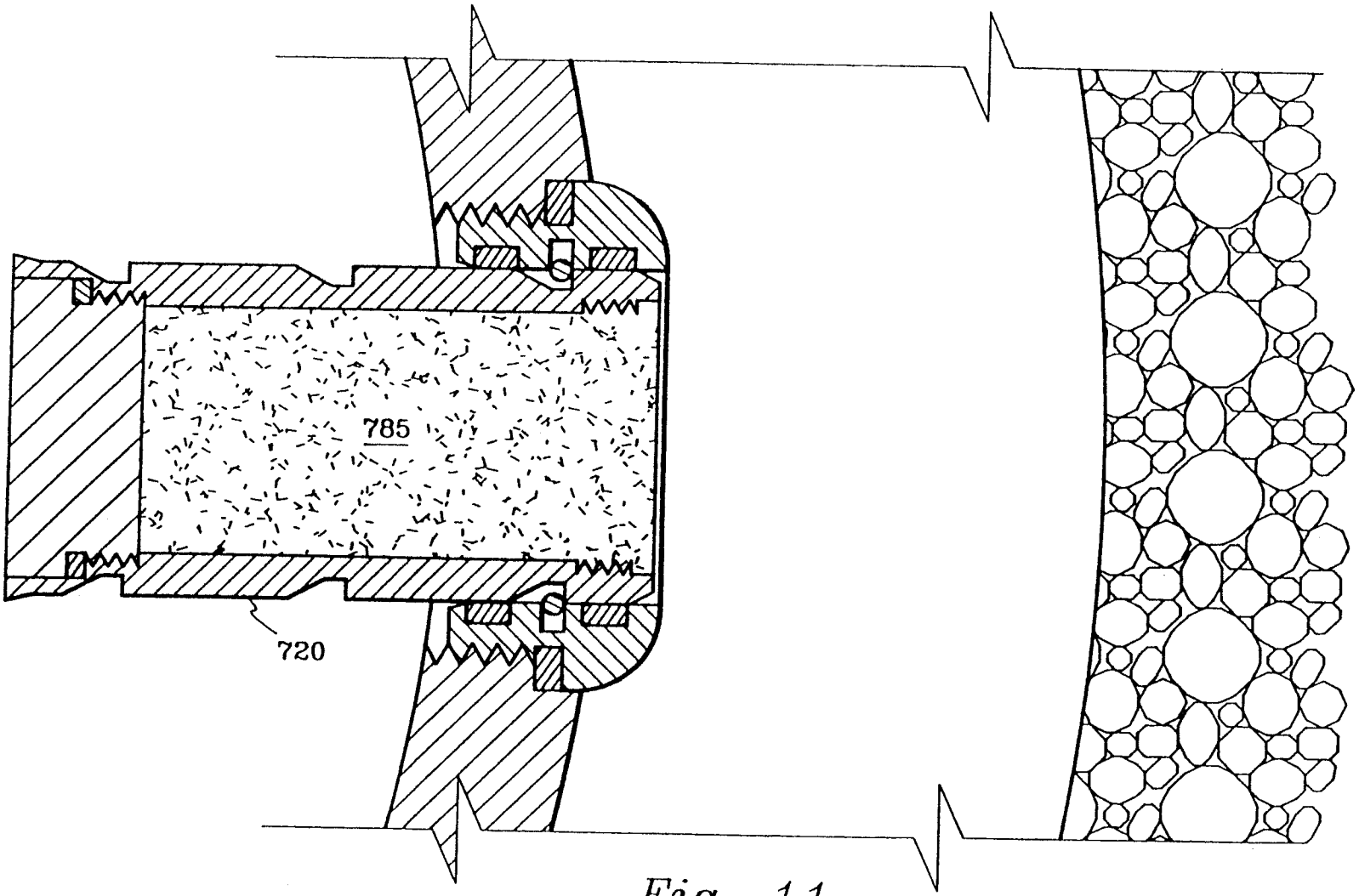
FIG. 11 is a fragmentary cross sectional view of a seventh embodiment of the downhole activated centralizer.

A seventh embodiment of the present invention is illustrated in FIG. 11 wherein the components of the centralizer 50 which are similar to previous components are similarly numbered with the prefix "7". The seventh embodiment is quite similar to the first embodiment illustrated in FIG. 4 with the addition of cathodic protection material 785 in the passageway. The cathodic protection material 785 is a metallic sacrificial material which provides cathodic protection for the casing when it is downhole. The piston 720 is deployed when the casing 60 is located in a suitable position and the sacrificial material will preferentially corrode or corrode in lieu of the casing 60 to provide protection therefor.

While it is recognized that there is a limited amount of cathodic protection, it is conventional to provide cathodic protection for the casing 60 at the surface. The cathodic protection provided by the sixth embodiment of the centralizer offers temporary protection until the conventional permanent cathodic protection is established. Moreover, among those in the field, the permanent protection is not regarded as being initially effective for various reasons although it eventually provides protection for the entire string to prevent the casing from being corroded through. The cathodic protection offered by a limited few of the centralizers 50 in the seventh embodiment should provide the intermediate protection desired. It should also be recognized that the cathodic protection may be used in conjunction with the other embodiments discussed above as well as other types of centralizers. While the seventh embodiment will provide centralizing for a pipe or casing, it does not necessarily have to centralize at all.

Figure 12:
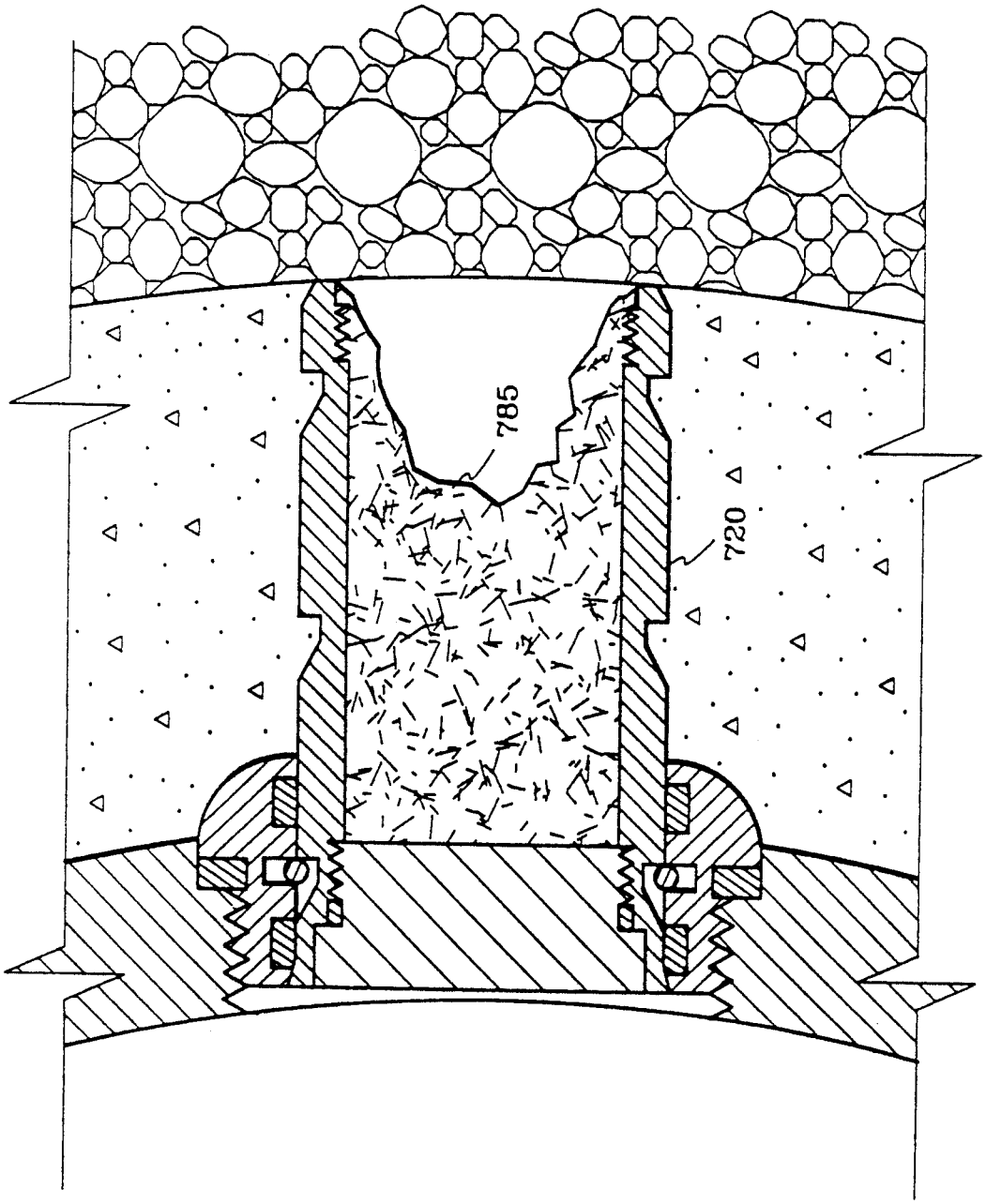
FIG. 12 is a fragmentary cross sectional view of the seventh embodiment of the downhole activated centralizer providing cathodic protection for the casing.

As best seen in FIG. 12, the seventh embodiment of the centralizer 50 is illustrated in the extended position with a portion of the sacrificial material corroded away. The plug 721 for this embodiment is preferably permanent so that the passageway 729 is permanently blocked. Since it will take some time for the sacrificial material to corrode away and it is preferable that it take as long as possible, it is impractical for the piston 720 to serve as a perforation to the formation.

The sacrificial material, as noted above, is a metal selected for its electrochemical properties and may be cast in place in the piston or cast separately and secured in the piston by screw threads 787. In the latter arrangement, the piston 720 in the original embodiment may be selectively provided with the cathodic protection insert at the site.

Figure 13:
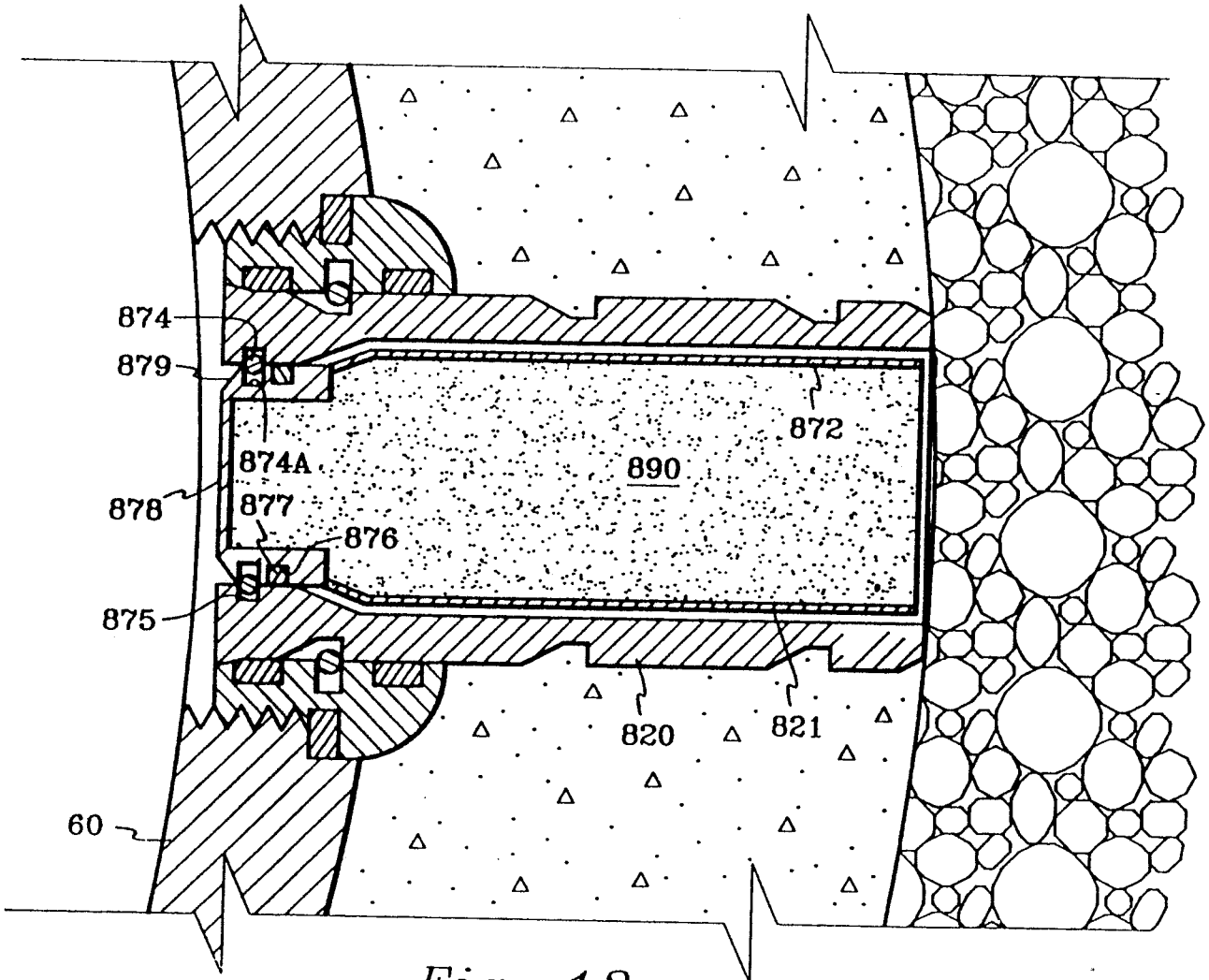
FIG. 13 is a fragmentary cross sectional view of an eighth embodiment of the downhole activated centralizer.

In FIG. 13, there is illustrated an eighth embodiment of the invention which is similar to the sixth embodiment illustrated in FIG. 9. In the eighth embodiment the plug 821 is inserted from the outside of the casing 60 after the piston 820 is installed in the casing 60. Like the second embodiment, the plug 821 includes a thin wall which may be destroyed by pressure or acid or other method. Within the sleeve 872 is fracture proppant material 890 which may be forced into the formation if the plug 821 is destroyed by pressure or if the plug 821 is acidized under pressure. Thus, the fracture proppant material 890 will be forced into the formation and hold the fractures open for later development and production. The sleeve 872 and fracture proppant material 890 provide other advantages in that debris from drilling the wellbore W cannot collect in the passageway 829 while the casing 60 is being run into the wellbore W. Accordingly, filling the passageway 829 with the fracture proppant material 890 provides a more favorable arrangement. It should be noted that some material such as cuttings saturated with loss prevention material and drilling mud are used because they are necessary to create the wellbore and not because they enhance the productivity of the formation. Often times, a lot of development work is required to undo or bypass damage caused while drilling the well. Accordingly, if the pistons 820 were to collect the undesirable materials as discussed above, then the well would require additional work to bring the formation into production since the undesirable material would be present at the walls of the wellbore and in the passageway to the formation.

Another advantage of this last embodiment is that if the formation is soft, the material 890 would provide an additional area of contact with the wall of the wellbore W. This aspect is similar to the operation of the shoe 261 in FIG. 5 except that in this last embodiment, the material 890 is within the outer profile of the piston 820.

The pistons may be filled with other material for other purposes. For example, the piston may be provided with a magnet or radioactive material or other such material that can be located by sensors lowered downhole. Accordingly, the location of the pistons containing such materials may be determined relative to zones and formations in the well during logging. Thus, during subsequent operations, the piston may be used as a marker for locating a particular zone.

Figure 14:
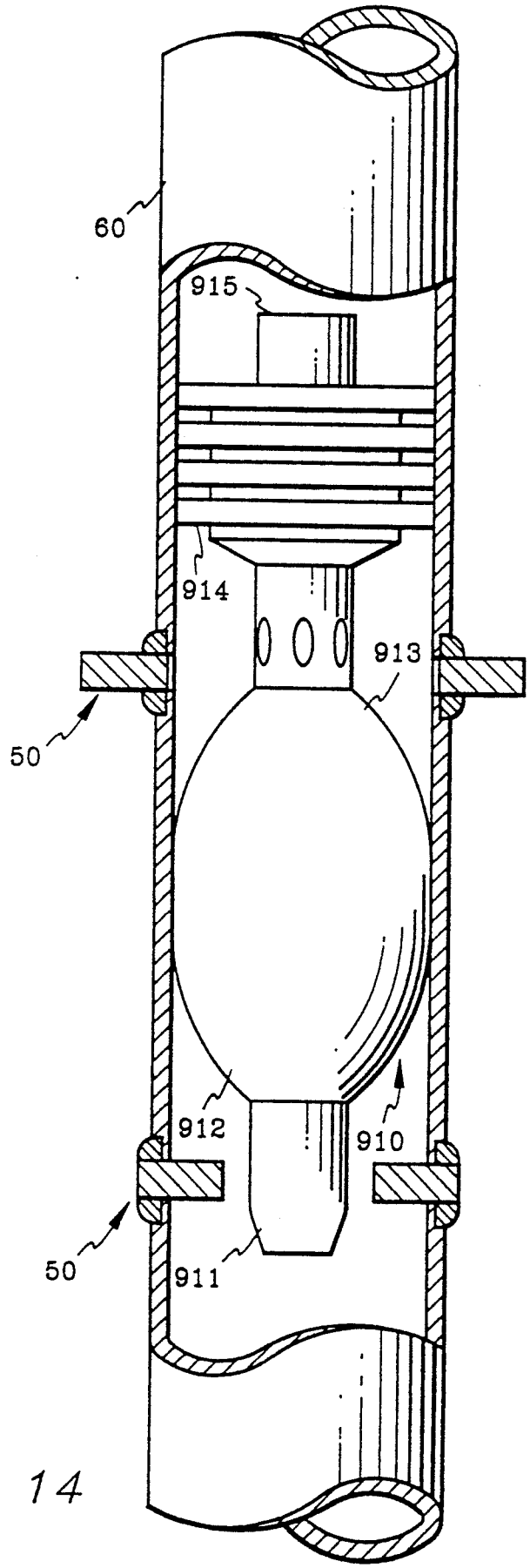
FIG. 14 is a fragmentary cross sectional view of a device for deploying the downhole activated centralizers.

In FIG. 14, there is illustrated a deploying device 910 for pushing the centralizers 50 outwardly from the retracted position to the extended position. The deploying device 910 comprises a shaft 911, and a tapered or bulbous section 912 for engaging the backside of the pistons and pushing them outwardly as the device 910 moves downwardly through the casing 60. A displacement plug 914 seals the shaft 911 to the inside of the casing 60 so that the device 910 may be run down through the casing 60 by hydraulic pressure like a conventional pig. Once the device 910 is at the bottom it may have other uses, such as a plug or it may be in the way where it must be fished out or drilled out. Alternatively, the shaft 911 could be connected at its tail end 915 by a mechanical linkage to a pipe string to be pushed down in the casing 60 from the well head and pulled back out. The bulbous portion 912 also includes an opposite taper at the bulbous portion for being withdrawn from the casing 60 by either the linkage or by a fishing device which retrieves the device 910 at the bottom of the casing string 60.

The centralizers 50 may also be deployed by hydraulic pressure in the casing as noted above. Accordingly, the casing pressure may be pumped up at the surface closing a valve at the base of the casing string 60 and exceeding the activation or deploying force required to move the pistons from the retracted position to the extended position. Accordingly, the pumps or other pressure creating mechanism would provide the necessary deploying force for the pistons.

In operation and to review the invention, the casing 60 is to be run into a well. It is preferable to have the casing 60 centralized so that an annulus of cement can be injected and set around the entire periphery of the casing to seal the same from the formation. A series of centralizers 50 are installed into the casing 60 such that the pistons are in the retracted position. While in the retracted position, the centralizers 50 are within the maximum outer profile of the casing 60 so as not to interfere with the installation of the casing 60. The centralizers may be installed in certain portions of the casing or may be installed along the entire length thereof and arranged to project from all sides of the casing 60. However, certain centralizers 50 may be predesignated for certain functions. For example, from logging reports and other analysis, it may be decided not to try and produce a certain portion of the formation and the portion of the casing which is expected to coincide with the non-produced portion will be provided with plugs that are permanent such as the plug 121 in FIG. 4. In an adjacent zone, it might be desirable to perforate the formation with a series of explosive plugs such as plug 621 in FIG. 9. In another region, plugs 821 may be used to establish communication with the formation without perforating the formation. A number of plugs having sacrificial material 785 such as illustrated in FIG. 11 may be interspersed along the length of the casing 60.

As noted above with regard to the sixth embodiment, the explosive charges may be installed into the pistons when the joint is ready to be run into the wellbore. During handling and installation of the explosive charges, nonessential personnel may be dispatched from the drilling rig floor as an additional safety precaution.

The casing 60 is run into the hole to be located in a suitable place in the wellbore W. Without the conventional externally mounted centralizer equipment, the casing 60 may be rotated and reciprocated to work past tight spots or other interference in the hole. The centralizers 50 further do not interfere with the fluid path through the casing string so that the casing may be circulated to clear cuttings from the end of the casing string. Also the casing could be provided with fluids that are less dense than the remaining wellbore fluids, such as drilling mud, causing the string to float. Clearly, the centralizers 50 of the present invention permit a variety of methods for installing the casing into the desired location in the wellbore W.

Once the casing 60 is in a suitable position, the centralizers are deployed to centralize the casing. As discussed above, there are several methods of deploying the centralizers. The casing may be pressured up by pumps to provide substantial hydraulic force to deploy the pistons. The pistons may not all deploy at once but as the last ones deploy the casing will be moved away from the wall of the wellbore W. Alternatively, a device such as in FIG. 14 may be used to deploy the pistons. The casing in this latter mode of operation would be centralized from the top to bottom. Once the pistons are all deployed and the snap rings have secured them in the extended position such that the pistons are projecting outwardly to the wall of the wellbore, cement may be injected into the annulus formed by the centralizing of the casing.

The casing 60 may be allowed to set while the production string is assembled and installed into the casing. It is important to note that at this point in the process of establishing the well that the casing and wellbore are sealed from the formation. Accordingly, there is as yet no problem with controlling the pressure of the formation and loss of pressure control fluids into the formation. In a conventional completion process a perforation string is assembled to create perforations in the casing adjacent the hydrocarbon bearing zone. Accordingly, high density fluids are provided into the wellbore to maintain a sufficient pressure head to avoid a blowout situation. While the production string is assembled and run into the well some of the fluids will leak into the formation. Unless replacement fluids are provided into the well, the pressure head will decrease until the well becomes unstable. Accordingly, the production string must be installed quickly to begin producing the well once the well has been perforated.

However, with the present invention, such problems are avoided. Once the casing is set in place, the production string may be assembled and installed before the plugs are destroyed. Thus, the process of establishing a well further includes the step of destroying the plugs by acid or by rupturing under pressure or by other means as discussed above. In the case of the explosive charges, if the detonators are hydraulically actuated, the hydraulic pressure necessary for the detonators to detonate would be significantly higher than the hydraulic pressure exerted on the pistons during deployment.

A variation on the process for establishing a producing well would be to provide a production string having one or more packers so that portions of the centralizers will be opened leaving others sealed for later development.

Since the production string is already in place in the well, production may begin when communication is established with the formation. Accordingly, the well is brought on-line in a more desirable manner. It should be noted that the process for providing cathodic protection for the entire casing string may also be addressed in a reasonable time frame rather than as soon as possible to prevent damage since the casing is protected from corrosion by the cathodic protection pistons.

It should be recognized that the invention has been described for casing in a wellbore for the production of hydrocarbons which includes many applications. For example, some wells are created for pumping stripping fluids down into the formation to move the oil toward another well which actually produces the oil. Also, the centralized pipe may be run into a larger pipe already set in the ground. For example, on an offshore drilling and production rig, a riser pipe is installed between the platform and the well head at the sea floor. Within the riser pipe other pipes are run which are preferably centralized. The centralizers 50 of the present invention may provide a suitable arrangement for such applications. There are other applications for this centralizing invention which have not been discussed but would be within the scope and spirit of the invention. Accordingly, it should be recognized that the foregoing description and drawings are illustrative of the invention and are provided for explanation and understanding. The scope of the invention should not be limited by the foregoing description and drawings but should be determined by the claims that follow.

I claim:

1. An apparatus for protecting a metal pipe from corroding in a wellbore wherein the wellbore is established for the production of hydrocarbons, the apparatus comprising:

a piston for being mounted in an opening in the peripheral wall of the pipe and for outward extensible movement to contact the wall of the wellbore, wherein the piston includes sacrificial cathodic protection material selected for its electrochemical properties to corrode in preference to the pipe;

means for deploying said piston from a retracted position which is generally within the maximum exterior profile of the pipe to an extended position wherein said piston projects outwardly from the opening to contact the wall of the wellbore; and means for securing said piston in said extended position to hold the piston to the wall of the wellbore.

2. The apparatus according to claim 1 wherein said sacrificial cathodic protection material is magnesium.

3. The apparatus according to claim 1 wherein the piston is hollow and said sacrificial cathodic protection material is cast into the hollow piston.

4. The apparatus according to claim 1 wherein the piston is hollow and said sacrificial cathodic protection material forms a plug which is installed into the hollow passageway of the piston to block the same.

5. An apparatus for spacing a pipe from the walls of a wellbore wherein the wellbore is established for the production of hydrocarbons, the apparatus comprising:

a piston for being mounted in an opening in the peripheral wall of the pipe and for outward extensible movement to contact the wall of the wellbore and move the pipe away therefrom, wherein the piston includes a sacrificial cathodic protection material selected for its electrochemical properties to corrode in preference to the pipe;

means for deploying said piston from a retracted position which is generally within the maximum exterior profile of the pipe to an extended position wherein said piston projects outwardly from the opening to contact the wall of the wellbore such that during deployment said piston may move the pipe away from the wall of the wellbore under the force of said deploying means; and means for securing said piston in said extended position to hold the pipe away from the wall of the wellbore.

6. The apparatus according to claim 5 further including means for retaining said piston in said retracted position until said deploying means is actuated to deploy said piston.

7. A pipe string for being inserted into a wellbore wherein the wellbore is established for the production of hydrocarbons, said apparatus comprising:

a plurality of pipe sections each having a peripheral wall;

a plurality of collar sections each having a peripheral wall for connecting said pipe sections end to end;

at least one of said sections being a centralizing section and including a plurality of openings in said peripheral wall thereof;

a piston mounted in each of said openings in said peripheral wall of said centralizing section for outward extensible movement to contact the wall of the wellbore and move the pipe away therefrom and at least some of said pistons including sacrificial cathodic protection material selected for its electrochemical properties to corrode in preference to the pipe string;

means for deploying said pistons from a retracted position which is generally within the maximum exterior profile of said pipe string to an extended position wherein said pistons extend generally radially from the opening to contact the wall of the wellbore such that during deployment said pistons may move said centralizing section away from the wall of the wellbore under the force of said deploying means; and means for securing said pistons in said extended position to hold said centralizing section away from the wall of the wellbore.

8. In a wellbore for the production of hydrocarbons having at least one product bearing zone, a pipe string having a peripheral wall and a region which is urged against the wall of the wellbore by a force such as gravity, wherein a section of said pipe string generally coinciding with said region being urged against said wall of said wellbore includes means for moving said pipe string away from said wall of said wellbore, wherein said means comprises:

a plurality of openings in said peripheral wall of said pipe string along said section thereof;

a piston mounted in each of said openings for outward extensible movement to contact said wall of said wellbore and move said pipe string away therefrom and at least some of said pistons including sacrificial cathodic protection material selected for its electrochemical properties to corrode in preference to the pipe string;

means for deploying said pistons from a retracted position which is generally within the maximum exterior profile of said pipe string to an extended position wherein said pistons project outwardly from said openings to contact said wall of said wellbore such that during deployment said pistons move said section away from said wall of said wellbore under the force of said deploying means; and means for securing said pistons in said extended position to hold said section away from said wall of said wellbore.

9. A pipe string for being inserted into a wellbore wherein the wellbore is established for the production of hydrocarbons, said apparatus comprising:

a plurality of pipe sections each having a peripheral wall;

a plurality of collar sections each having a peripheral wall for connecting said pipe sections end to end;

at least one of said sections being a centralizing section and including a plurality of generally radial openings in said peripheral wall thereof;

a piston mounted in each of said openings in said peripheral wall of the centralizing thereof for outward extensible to contact the wall of the wellbore and move the pipe away therefrom, wherein certain preselected pistons include explosive material therein and other pistons include sacrificial cathodic protection material selected for its electrochemical properties to corrode in preference to the pipe string;

means for deploying said piston from a retracted position which is generally within the maximum exterior profile of said centralizing section to an extended position wherein said piston projects outwardly to contact the wall of the wellbore such that during deployment said piston may move said centralizing section away from the wall of the wellbore under the force of said deploying means;

means for securing said piston in said extended position to hold said centralizing section away from the wall of the wellbore; and means for detonating said explosive material in said preselected pistons to create extensive fractures within the formation adjacent to said pistons for the formation to communicate with the pipe.

10. In a wellbore for the production of hydrocarbons having at least one product bearing zone, a pipe string having a peripheral wall and a region which is urged against said wall of said wellbore by a force such as gravity, wherein a section of said pipe string generally coinciding with said region being urged against the wall includes means for moving said pipe string away from said wall of said wellbore, wherein said means comprises:

a plurality of openings in said peripheral wall of said pipe string along said section thereof;

a piston mounted in each of said openings for outward extensible to contact the wall of the wellbore and move said pipe string away therefrom, wherein certain preselected pistons include an explosive material therein and other pistons include sacrificial cathodic protection material selected for its electrochemical properties to corrode in preference to the pipe string;

means for deploying said pistons from a retracted position which is generally within the maximum exterior profile of said centralizing section to an extended position wherein said pistons project outwardly to contact the wall of the wellbore such that during deployment said pistons move said section away from the wall of the wellbore under the force of said deploying means;

means for securing said pistons in said extended position to hold said section away from the wall of the wellbore; and means for detonating said explosive material in said preselected pistons to create extensive fractures within the formation adjacent to said preselected pistons for the formation to communicate with the pipe.

11. A method for protecting a metal pipe from corroding in a wellbore wherein the wellbore is established for the production of hydrocarbons, the method comprising the steps of:

running a pipe into the wellbore wherein the pipe has at least on opening in the peripheral wall thereof and a piston mounted in the opening for outward extensible movement to contact the wall of the wellbore, wherein the piston includes sacrificial cathodic protection material selected for its electrochemical properties to corrode in preference to the pipe;

deploying the piston from a retracted position which is generally within the maximum exterior profile of the pipe to an extended position wherein the piston projects outwardly from the opening to contact the wall of the wellbore; and securing the piston in the extended position to hold the piston to the wall of the wellbore.

12. A method of installing a pipe in a wellbore, wherein the wellbore is for the production of hydrocarbons and wherein the pipe is preferably spaced from the walls of the wellbore, the process comprising the steps of:

running the pipe into the wellbore wherein a portion of the pipe has a plurality of pistons installed in openings in the peripheral wall of the pipe for outward extensible movement from a retracted position generally within the maximum exterior profile of the pipe to an extended position wherein the piston projects outwardly from the pipe and wherein at least some of the pistons include sacrificial cathodic protection material selected for is electrochemical properties to corrode in preference to the pipe;

deploying the pistons from the retracted position to the extended position when the pipe is suitably positioned in the wellbore to move portions of the pipe which are in contact with the walls of the wellbore away therefrom so that the pipe is spaced from the walls of the wellbore; and securing the piston in the extended position to hold the pipe away from the walls of the wellbore.

13. The method according to claim 12 further comprising the step of retaining the piston in the retracted position until the pistons are deployed to the extended position.

14. The method according to claim 13 further comprising the step of stopping the outward movement of the pistons at the extended position during the step of deploying the pistons.

15. A method for installing pipe casing into a wellbore, wherein the wellbore is established for the production of hydrocarbons and wherein the pipe casing is to establish fluid communication between the casing and predetermined zones in the wellbore while excluding fluid communication with other zones, the method comprising the steps of:

running a pipe string into the wellbore wherein portions of the pipe string are provided with a plurality of pistons installed in openings in the peripheral wall of the pipe string for outward extensible movement from a retracted position generally within the maximum exterior profile of the pipe to an extended position wherein the pistons project outwardly from the pipe string such that while running the pipe string into the wellbore, the pistons are retracted to minimize drag of the pipe string and provide clearance for following bends and turns in the wellbore and wherein at lest some of the pistons contain sacrificial cathodic protection material selected for its electrochemical properties to corrode in preference to of the pipe casing;

deploying the pistons from the retracted position to the extended position when the pipe is suitably positioned in the wellbore to move portions of the pipe which are in contact with the walls of the wellbore away therefrom so that the pipe is spaced from the walls of the wellbore;

securing the pistons in the extended position to hold the pipe casing away from the wall of the wellbore;

injecting cement into the annulus between the wellbore and the pipe string to seal the periphery of the pipe string and the wellbore so that fluids cannot migrate along the wellbore from one zone to another; and establishing fluid communication between the interior of the pipe string and the downhole formation at a predetermined zone of interest.

16. A method of installing a pipe in a wellbore wherein the wellbore is for the production of hydrocarbons and the pipe is preferably spaced from the walls of the wellbore, the process comprising the steps of:

running the pipe into the wellbore wherein a portion of the pipe has a plurality of pistons installed in openings in the peripheral wall of the pipe for outward extensible movement from a retracted position generally within the maximum exterior profile of the pipe to an extended position wherein the pistons project outwardly from the pipe, wherein certain preselected pistons include explosive material therein and other pistons include sacrificial cathodic protection material therein selected for its electrochemical properties to corrode in preference to the pipe;

deploying the pistons from the retracted position to the extended position when the pipe is suitably positioned in the wellbore to move portions of the pipe which are in contact with the walls of the wellbore away therefrom so that the pipe is spaced from the walls of the wellbore;

securing the pistons in the extended position to hold the pipe away from the walls of the wellbore; and detonating the explosive material in the preselected pistons to create extensive fractures within the formation adjacent to the preselected pistons for the formation to communicate with the pipe.

17. The method according to claim 16 further comprising the step of retaining the piston in the retracted position until the piston is deployed to the extended position.

18. The method according to claim 16 further comprising the step of stopping the outward movement of the piston at the extended position during the step of deploying the pistons.

19. A method for installing pipe casing into a wellbore wherein the wellbore is established for the production of hydrocarbons and the pipe casing is to establish fluid communication between the casing and predetermined zones in the wellbore while excluding fluid communication with other zones, the method comprising the steps of:

running a pipe string into the wellbore wherein portions of the pipe string are provided with a plurality of pistons installed in openings the peripheral wall of the pipe string for outward movement from a retracted position generally within the maximum exterior profile of the pipe to an extended position wherein the piston projects generally radially outwardly from the pipe such that while running the pipe string into the wellbore, the pistons are retracted to minimize drag of the pipe string and provide clearance for following bends and turns in the wellbore, and further wherein certain preselected pistons include explosive material therein and other pistons include sacrificial cathodic protection material therein which is selected for its electrochemical properties to corrode in preference to the pipe casing;

deploying the pistons from the retracted position to the extended position when the pipe is suitably positioned in the wellbore to move portions of the pipe which are in contact with the walls of the wellbore away therefrom so that the pipe is spaced from the walls of the wellbore;

securing the pistons in the extended position to hold the pipe casing away from the wall of the wellbore;

injecting cement into the annulus between the wellbore and the pipe string to seal the periphery of the pipe string and the wellbore so that fluids cannot migrate along the wellbore from one zone to another; and detonating the explosive material in the preselected pistons to create extensive fractures within the formation adjacent to the preselected pistons for the formation to communicate with the pipe.

* * * * *